United States Patent [19]

Beard

[11] 4,077,548

[45] Mar. 7, 1978

[54] TRIGGER ACTUATOR FOR DISPENSING PUMPS WITH SADDLE PULL-DOWN

[76] Inventor: Walter C. Beard, South St., Middlebury, Conn. 06762

[21] Appl. No.: 753,992

[22] Filed: Dec. 27, 1976

[51] Int. Cl.[2] ..... B65D 83/00

[52] U.S. Cl. ..... 222/321; 222/385

[58] Field of Search ..... 222/320, 321, 385, 509

[56] References Cited

U.S. PATENT DOCUMENTS

| | | | |
|---|---|---|---|
| 1,489,172 | 4/1924 | Symons | 222/321 X |
| 2,730,958 | 1/1956 | Nelson | 222/385 X |
| 3,012,699 | 12/1961 | Denman | 222/385 X |
| 3,478,935 | 11/1969 | Brooks | 222/321 |

*Primary Examiner*—Allen N. Knowles

*Attorney, Agent, or Firm*—DeLio and Montgomery

[57] ABSTRACT

A trigger-like actuating element for association with a pump having a depressible piston or plunger for dispensing small metered quantities of a liquid from a container such as a jar, bottle or can, the trigger-like element being designed to be manually operated for substantially horizontal movement to thereby depress vertically the pump piston or plunger in order to deliver a quantity of liquid, usually as a spray, in a horizontal direction.

6 Claims, 7 Drawing Figures

TRIGGER ACTUATOR FOR DISPENSING PUMPS WITH SADDLE PULL-DOWN

This invention relates to a trigger actuated pump for dispensing small quantities of a liquid from a container such as a jar, bottle or can, and particularly to the trigger and/or trigger assembly elements of such pumps. Other forms of trigger assemblies are disclosed and claimed in applications Ser. No. 753,995 and Ser. No. 753,991, the latter now abandoned, both filed on Dec. 27, 1976.

Efforts are currently under way to minimize the use of aerosol spray dispensing units (in fact, to eliminate the use of such propellants as the fluorocarbons) and such efforts include the development of pump-type dispensers. Typical examples of such dispensers have spray heads which are vertically depressible and which have laterally opening nozzles, as shown in applicant's U.S. Pat. No. 3,940,028, Feb. 24, 1976.

As an alternative to pumps operated by downward pressure on the spray head, several varieties of trigger type sprayers have been developed, many being based on the device shown in Tyler U.S. Pat. No. 3,061,202, Oct. 30, 1962, and having the piston-cylinder axis either horizontal or at an angle of 45° or less from horizontal. An example of a vertically actuated pump is shown in Hellenkamp U.S. Pat. No. 3,840,157, Oct. 8, 1974, wherein a trigger forces a plunger upward into a cylindrical cavity to discharge the spray horizontally. Another trigger for actuating a vertical pump is shown in Brooks U.S. Pat. No. 3,478,935, Nov. 18, 1969.

It is an object of the present invention to provide a trigger assembly adapted to be combined with a vertically operating pump of the type exemplified by applicant's U.S. Pat. No. 3,940,028 with little or no modification of the pump elements.

It is another object of the invention to provide a trigger assembly by which the spray head (modified or not) of a vertically operating pump can be depressed to eject or spray in a manner comparable to the manual depression of a spray head.

It is a further object of the invention to provide such a trigger assembly wherein the components are of simple form and can be made and assembled inexpensively to constitute a very effective operating unit.

It is a more specific object of the invention to provide a connection between the trigger and the spray head in the nature of a saddle by means of which the trigger is enabled to pull down the push button of the spray head.

It is yet another object of the invention to provide certain improvements in the form, construction and arrangement of the several parts whereby the above-named and other objected may effectively be attained.

The invention accordingly comprises an article of manufacture possessing the features, properties, and the relation of elements which will be exemplified in the article hereinafter described, and the scope of the invention will be indicated in the claims.

Practical embodiments of the invention are shown in the accompanying drawings, wherein.

Figure 1:
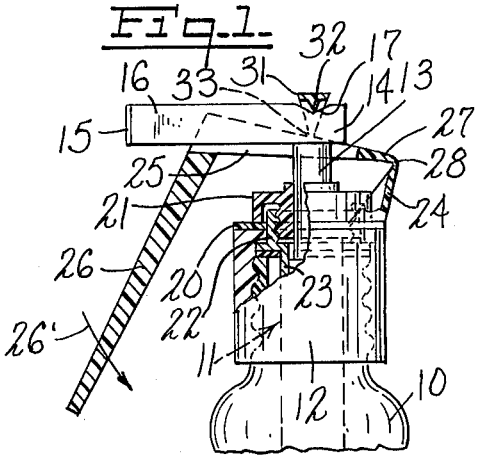
FIG. 1 represents an elevation of one form of trigger in combination with a pump and container, the trigger being in released position.
Figure 2:
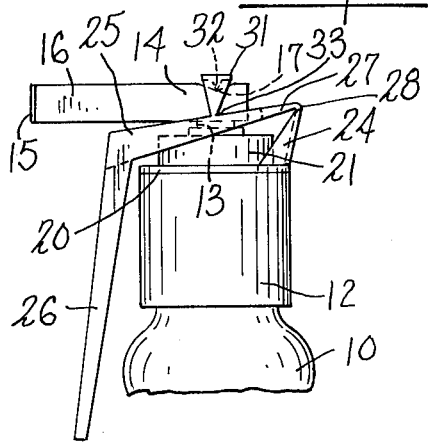
FIG. 2 represents an elevation of the trigger assembly shown in FIG. 1, with the trigger in depressed position.

Referring to the drawings, and particularly to FIGS. 1 and 2, a container 10 such as a bottle or can is shown as being equipped with a pump mechanism 11 fixed in the top of a screw cap 12 on the neck of the container, the pump having an upwardly projecting tubular plunger 13 on which is mounted the push button 14 containing a spray nozzle 15. The push button 14 is functionally comparable to the push button 41 in applicant's U.S. Pat. No. 3,940,028, but is modified to include a horizontally extending tubular portion 16 having the spray nozzle 15 at its distal end. The push button is provided also with an upwardly facing dimple or groove 17, located approximately on the axis of the plunger 13.

The trigger assembly for operating the pump just described includes a flat annular base 20 engaged tightly between the pump collar 21 and the top of the cap, the collar having an inner portion which engages a ring 22 on the pump chamber 23 with a snap or friction fit. The base supports a post 24 extending upwardly and somewhat outwardly therefrom. The trigger includes a bifurcated body portion 25 and the depending finger piece 26, the body portion being closed at its rear end 27 and connected by an integral hinge 28 to the top of the post 24. The sides of the body portion are spaced to clear freely the sides of the push button 14 and its extension 16. The trigger is functionally connected to the pump by means of a saddle 31, the bridge portion of which engages the push button by means of a peak or ridge 32, resting in the dimple or groove 17, the sides of the saddle being flexibly connected to the sides of trigger body portion at the narrow connection points 33.

The finger piece 26, at rest, is spaced from the container neck and below the nozzle 15 (FIG. 1); upon actuation in the direction of the arrow 26' the finger piece moves toward the position shown in FIG. 2 and the push button, nozzle and plunger are pulled downward, with expulsion of the container contents through the nozzle.

The distance between the hinge 28 and the connection points 33 is substantially less than the distance between the hinge and the area of the finger piece 26 which would normally be engaged by the user's finger so that the lever arm, in use, results in multiplication of the force, the push button thus being depressed effectively by the exertion of relatively little finger power. Throughout the operating stroke, the force exerted by the saddle 31 on the push button has a minimal lateral component in comparison to the vertical component and hence depresses the plunger with minimal tendency toward binding. As the parts move from released position (FIG. 1) to depressed position (FIG. 2) the saddle rocks slightly, relative to the trigger body, around the points 33 as pivot points, enabling the bridge portion of the saddle to move straight down on the axis of the plunger.

Figure 3:
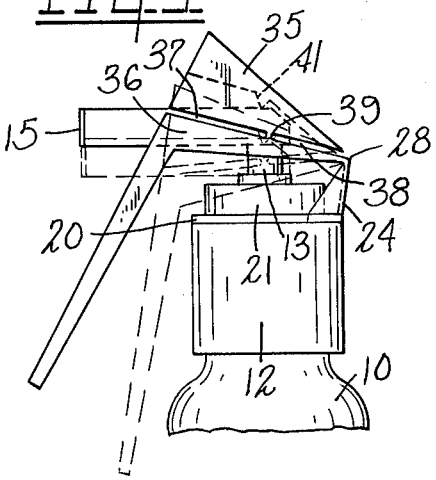
FIG. 3 represents an elevation of a first modified form of trigger in combination with a pump and container, the depressed position being indicated in broken line.

In the first modified form of trigger, shown in FIG. 3, the parts are like those just described but the saddle is enlarged to provide triangular side portions 35, spaced from the trigger body 36 by narrow slots 37, 38 forward and rearward from the narrow connection points 39. Since the side portions cannot rock appreciably around the connection points, the saddle actuates the pump by means of a peak or ridge 41 bearing slidingly on the smooth upper surface of the push button, from which the dimple or groove (17 in FIG. 1) has been omitted.

Figure 4:
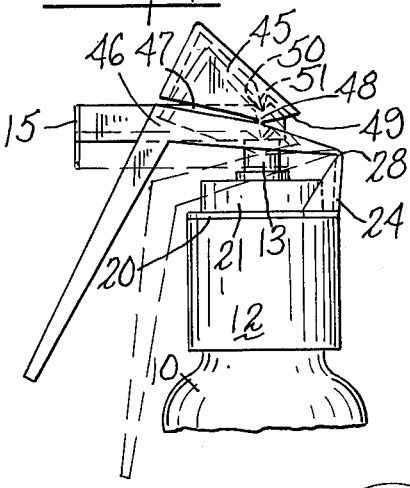
FIG. 4 represents an elevation of a second modified form of trigger assembly, the depressed position being indicated by broken lines.

In the second modified form shown in FIG. 4(similar to FIG. 3) the saddle is again enlarged to provide triangular side portions 45 spaced from the trigger body 46 by narrow slots 47 extending forward from the narrow connection points 48, but rearwardly the slots 49 are wide V-shaped openings which permit the portions 45 to rock around the connection points, like the saddles 31 in FIGS. 1 and 2, the depressed positions being shown in broken lines. The upper surface of the push button is provided with a dimple or groove 50 (like 17 in FIG. 1) in which the peak or ridge 51 is engaged.

The extended side portions 35 and 45 in FIG. 3 and 4 could be made with profiles other than the generally triangular or peaked forms shown, so long as they serve as partial covers for the push buttons, provide an attractive finish for the top of the pump and trigger assembly and provide an area on which such indicia as names, trademarks, or the like can be applied, if desired.

FIGS. 1 to 4 show the use of trigger assemblies with pumps wherein the push buttons have been modified by providing lateral extensions, to place the nozzles well beyond the triggers where the spray is not likely to contact either the trigger or the fingers of the user. It is, however, quite expedient to add triggers to pumps having normal cylindrical push button-nozzle elements, particularly where the latter have a substantial vertical dimension, i.e., when the nozzle opening is spaced a substantial distance above the top of the container, as shown in FIGS. 5 and 6.

Figure 5:
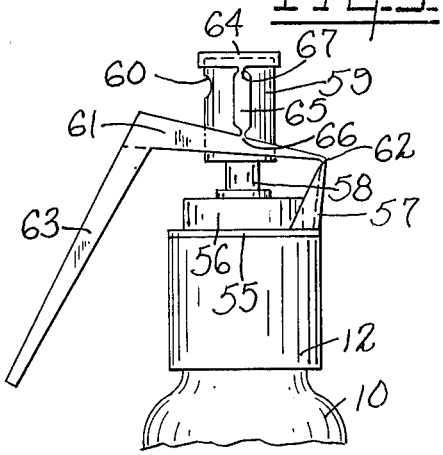
FIG. 5 represents an elevation of a third modified form of trigger assembly, in released position.

The saddle-type trigger mechanism shown in FIG. 5 includes a base 55 held by collar 56 and provided with an upstanding post 57, all as in FIG. 1. The pump plunger 58 carries a cylindrical push button 59 having a nozzle 60 near its top. The trigger body portion 61 is bifurcated, to straddle the push button, and is hinged to the top of the post by an integral hinge 62, the finger piece 63 projecting downward and outward from the front end of the body portion. Actuation of the push button is effected through a saddle in the form of a cap 64, fitted tightly on the top of the push button, the cap being connected to the sides of the body portion by links 65 (one on each side), each link extending between narrow flexible upper and lower connection points 66,67, which provide sufficient flexibility for easy operation. It will be apparent that, as the trigger is depressed, the points 67 will move in a short arc around the hinge 62 as a center while the points 66 must move vertically, parallel to the axis of the plunger, so that the links 65 rock slightly during each stroke. The pulling force communicated to the cap and push button deviates only slightly from vertical and has minimal binding tendencies.

Figure 6:
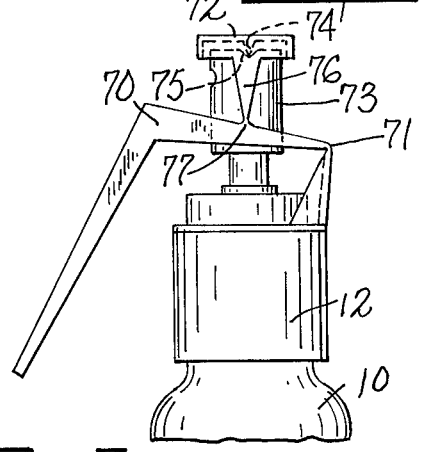
FIG. 6 represents an elevation of a fourth modified form of trigger assembly in released position.

The trigger assembly of FIG. 6 differs from that of FIG. 5 only in the cap-shaped saddle and connecting link arrangement, which correspond closely to the elements of FIG. 1. The trigger 70 is hinged at 71. The cap 72 covers the top of the push button 73 but engages it only through the peak or ridge 74 which may rest in a dimple or groove 75 in the top of the push button. The cap is provided with connecting links 76, like links 65 but so formed as to be rigid with the cap while being connected to the trigger through narrow flexible connection points 77. Upon actuation of the trigger to depress the push button the connection points 77 move in a short arc around the hinge 71 as a center, and the integral cap and link unit rocks correspondingly on the point of engagement between peak or ridge 74 and the dimple or groove 75, as an axis, while transmitting downward force to the push button.

References herein to a "peak or ridge" and a "dimple or groove" are in the alternative because, in each instance, substantially equivalent results can be achieved by forming the respective elements either with or without a substantial linear dimension. The precise form of the protrusion (peak or ridge) is not critical so long as a suitable complementary depression (dimple or groove) is provided.

Figure 7:
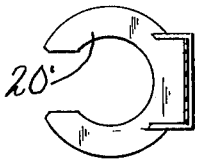
FIG. 7 represents a detail plan view of an alternative form of trigger assembly base.

The trigger assemblies described above are adapted for addition to the respective pumps at the time of manufacture, the flat annular base (20) being placed on top of the cap (12) before the retaining collar (21) is secured to the pump chamber (referring to FIG. 1). The annular base may, however, be cut away on one side, as shown in FIG. 7, the base 20' then being adapted for addition to a complete pump by loosening the collar just enough to enable the base to be slipped between the collar and the container cap which hold it frictionally in operative position.

Most currently used dispensing pumps are constructed with elements corresponding to the collar 21, adapted to be snapped or otherwise fitted onto or into a complementary pump element in a manner permitting the addition of an annular or open sided trigger base (such as 20 or 20'), so that trigger and base assemblies of the types shown and described above require only adaptation to the pertinent diameters and heights of particular pumps in order to be added thereto.

In order to equip a pump as shown in applicant's U.S. Pat. No. 3,940,028 with a trigger mechanism according to any of the forms shown and described herein, it is necessary to replace the cylindrical push button 41 of the patent with a laterally extended push button of the selected type (in the case of FIGS. 1 to 4), and to affix the annular base of the trigger assembly to the cover portion of the cap, as by means of a suitable adhesive. Such attachment can be resorted to in most situations where an element such as the collar 21 is not available.

Each of the trigger and base assemblies described above is adapted for molding from a suitable plastic material having adequate rigidity throughout, particularly, the base, post and trigger, while being flexible in such attenuated areas as the hinges and saddle connection points. Fatigue resistance in the flexible areas is also important.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. In combination with a pump for dispensing liquid from a container, the pump being adapted for actuation by vertical depression of a push button on the plunger and having a spray nozzle associated with the push button for directing laterally the dispensed liquid, pump actuating means comprising an annular base adapted for securement on the top of a container closure member, a trigger mounting post projecting upwardly from the base, an elongated trigger having one end hinged to the top of the post, an intermediate portion bifurcated to pass either side of the push button and nozzle and the other end extending downward below the nozzle to constitute a finger piece, and a saddle having a bridge portion resting on the push button and side portions each connecting one end of the saddle to one side of the bifurcated trigger portion by at least one flexible connection point, permitting said side portions to rock relatively to the trigger in the vertical plane of movement of the trigger, whereby depression of the trigger pulls the push button downward.

2. Pump actuating means accordingly to claim 1 wherein each side portion is connected to the bridge portion by a flexible connection point, permitting said side portions to rock relatively to the bridge portion.

3. Pump actuating means according to claim 2 wherein the push button is cylindrical and the bridge portion is in the form of a cap fitted on the push button.

4. Pump actuating means according to claim 1 wherein each side portion is rigidly connected to the bridge portion and the bridge portion has a rocking contact with the push button.

5. Pump actuating means according to claim 4 wherein the push button is cylindrical and the bridge portion is in the form of a cap.

6. Pump actuating means according to claim 1 wherein the saddle bridge and side portions are extended to provide usable indicia bearing surfaces.

* * * * *